US011001409B2

(12) United States Patent
Huber et al.

(10) Patent No.: US 11,001,409 B2
(45) Date of Patent: May 11, 2021

(54) POURING ELEMENT FOR A PACKAGE AND COMPOSITE PACKAGE HAVING SUCH A POURING ELEMENT

(71) Applicant: SIG Technology AG, Neuhausen am Rheinfall (CH)

(72) Inventors: Hansjörg Huber, Radolfzell (DE); Martin Ruegg, Uhwiesen (CH)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 15/740,900

(22) PCT Filed: Jun. 9, 2016

(86) PCT No.: PCT/EP2016/063112
§ 371 (c)(1),
(2) Date: Dec. 29, 2017

(87) PCT Pub. No.: WO2017/001162
PCT Pub. Date: Jan. 5, 2017

(65) Prior Publication Data

US 2018/0194512 A1 Jul. 12, 2018

(30) Foreign Application Priority Data

Jun. 30, 2015 (DE) ..... 10 2015 110 529.2
Jun. 30, 2015 (EP) ..... 15020107

(51) Int. Cl.
*B65D 5/74* (2006.01)
*B65D 47/12* (2006.01)
*B65D 8/00* (2006.01)

(52) U.S. Cl.
CPC ..... *B65D 5/746* (2013.01); *B65D 47/122* (2013.01); *B65D 11/04* (2013.01); *B65D 2547/063* (2013.01)

(58) Field of Classification Search
CPC ..... B65D 5/746; B65D 47/122; B65D 2547/063; B65D 11/04
See application file for complete search history.

(56) References Cited

U.S. PATENT DOCUMENTS 3,690,524 A * 9/1972 Haberhauer ..... B29C 65/18 222/573
4,471,882 A 9/1984 Joo
(Continued)

FOREIGN PATENT DOCUMENTS

CN 1525923 A 9/2004
CN 1942367 A 4/2007
(Continued)

*Primary Examiner* — Vishal Pancholi
*Assistant Examiner* — Bob Zadeh
(74) *Attorney, Agent, or Firm* — The Webb Law Firm

(57) ABSTRACT

A pouring element for a package having a base body, a polyhedrally formed flange which is designed for joining to a package sleeve and whose joining faces converge in face abutments, as well as a pouring element for a package, in which the package sleeve is correspondingly joined to the pouring element. Provision is made for receiving areas to be formed in the area of the face abutments for the fold line of the package sleeve ears, in order to prevent the package from becoming damaged during the joining process between the pouring element and the package sleeve and during the folding of the package sleeve ears and hence keep it leak-tight.

14 Claims, 7 Drawing Sheets

(56) References Cited

U.S. PATENT DOCUMENTS

| | | | | | |
|---|---|---|---|---|---|
| 5,255,813 | A * | 10/1993 | Berggren | B65D 5/746 | 215/202 |
| 5,765,747 | A * | 6/1998 | Lawson | B65D 5/746 | 222/541.9 |
| 6,523,548 | B2 * | 2/2003 | Bouix | A45D 40/265 | 132/218 |
| 7,597,244 | B2 * | 10/2009 | Boldrini | B65D 15/22 | 229/110 |
| 2001/0015355 | A1 * | 8/2001 | Adams | B65D 5/746 | 220/258.2 |
| 2003/0000963 | A1 * | 1/2003 | Julian | B65D 5/748 | 222/107 |
| 2004/0169066 | A1 | 9/2004 | Palm | | |
| 2005/0127118 | A1 * | 6/2005 | Boldrini | B65D 5/746 | 222/556 |
| 2005/0139607 | A1 * | 6/2005 | Kobetsky | B29C 65/18 | 222/92 |
| 2007/0095834 | A1 * | 5/2007 | Von Spreckelsen | B65D 5/749 | 220/258.2 |
| 2007/0170233 | A1 | 7/2007 | Fontanazzi | | |
| 2009/0261154 | A1 * | 10/2009 | Scheu | B65D 5/746 | 229/214 |
| 2013/0233912 | A1 * | 9/2013 | Piotrowski | B65D 11/04 | 229/117.3 |
| 2013/0256336 | A1 | 10/2013 | Himmelsbach et al. | | |
| 2013/0305659 | A1 * | 11/2013 | Kenn | B65B 3/027 | 53/426 |
| 2018/0186505 | A1 * | 7/2018 | Peterges | B65D 5/747 | |
| 2018/0194512 | A1 * | 7/2018 | Huber | B65D 5/746 | |
| 2018/0273268 | A1 * | 9/2018 | Franca | B65D 75/5883 | |

FOREIGN PATENT DOCUMENTS

| | | | | | |
|---|---|---|---|---|---|
| CN | 103153801 | A | | 6/2013 | |
| CN | 206857293 | U | * | 1/2018 | B65D 5/746 |
| DE | 102005048821 | A1 | | 4/2007 | |
| DE | 102010050502 | A1 | | 5/2012 | |
| DE | 102012020529 | A1 | | 4/2014 | |
| EP | 1487705 | B1 | | 5/2007 | |
| EP | 1503940 | B1 | | 9/2009 | |
| JP | 406099972 | A | * | 4/1994 | B65D 5/746 |
| JP | 406122446 | A | * | 5/1994 | B65D 5/746 |
| JP | 2004155453 | A | | 6/2004 | |
| WO | 03086880 | A1 | | 10/2003 | |
| WO | WO-03086880 | A1 | * | 10/2003 | B29C 65/08 |
| WO | 2012048935 | A1 | | 4/2012 | |
| WO | 2012062565 | A1 | | 5/2012 | |
| WO | 2014060133 | A1 | | 4/2014 | |

* cited by examiner

POURING ELEMENT FOR A PACKAGE AND COMPOSITE PACKAGE HAVING SUCH A POURING ELEMENT

CROSS-REFERENCE TO RELATED APPLICATIONS

This application is the United States national phase of International Application No. PCT/EP2016/063112 filed Jun. 9, 2016, and claims priority to German Patent Application No. 10 2015 110 529.2 and European Patent Application No. 15020107.7, each filed Jun. 30, 2015, the disclosures of which are hereby incorporated in their entirety by reference.

BACKGROUND OF THE INVENTION

Field of the Invention

The invention relates to a pouring element for a package, in particular a composite package for liquid foods with a polyhedrally formed gable area and folded package sleeve ears, having a base body, a polyhedrally formed flange which is designed for joining to a package sleeve and whose joining faces converge in face abutments, as well as to a composite package for liquid foods with a polyhedrally formed gable area and folded package sleeve ears.

Description of Related Art

In packaging technology, composite packaging has been part of the established prior art for a long time. Thus, for example, beverage cartons consist of different packaging materials, such as paper and plastic materials, which when joined and pressed together over their full surfaces form a packing laminate. The layer composition can vary according to requirements and so, for example, for aseptic filling goods an aluminium layer is additionally inserted, in order to obtain a good barrier effect against gases and light. Often—but not always—the laminate is even cut to packaging size during its production and in this way so-called package sleeves are formed. Alternatively, the packing laminate is often also supplied as a rolled product and only cut to size later.

The actual shaping and filling of the package and closing it to form a package usually takes place in a packaging machine which is frequently also called a form-fill-seal-machine referring to its main functions. Liquid foods, such as beverages, soups, yoghurt or suchlike, predominantly qualify as filling goods.

Such packages are often also provided with pouring elements. In addition to controlled pouring, these pouring elements usually also enable the consumer to reclose the package. Frequently and predominantly with aseptic use, a first opening function is also provided for the package. Here, the previously gas-tight sealed package is opened for the first time. This can be effected, for example, by means of a pull ring or tab or by means of a piercing and/or cutting device. Such piercing and/or cutting devices are often designed as cutting rings which are frequently linked to the screw cap, for example, via drive means, so that by twisting the screw cap the package is at the same time cut open.

WO 2012/048935 A1 originating from the applicant demonstrates a pouring element of the type mentioned, for example. This pouring element essentially consists of a base body which is sealed by means of a screw cap and in addition to the actual pouring neck also has a flange for joining to the rest of the package parts. The pouring elements are incorporated into the package when the package is being formed and before actual filling takes place and also form a part of the package. Depending on the package shape and type, the pouring element is applied from the inside through a pre-cut hole in the flat gable of the package. The flange of the pouring element then extends parallel to the plane of the flat gable of the package, as is disclosed in the first exemplary embodiment shown there. However, it is also possible for the pouring element itself to form the top area of the package, as shown in the further illustrated exemplary embodiment. The joining flange projects angled from the actual pouring element and forms a polyhedrally formed flange which in the example shown essentially corresponds to a truncated pyramid. The polyhedrally formed flange is then joined to the package sleeve.

The pouring element is usually incorporated and joined to the package in packaging machines which have already been mentioned at the beginning. Such a packaging machine is disclosed in WO 2012/062565 A1 originating from the applicant, in which a special package form is created. This has a polyhedrally formed gable area which consists of a plurality of gable surfaces and a pouring element. The gable area tapers towards the pouring element such that the cross-sectional area of the package decreases in the pouring direction. In the illustrated exemplary embodiment, this gable area is essentially in the shape of a truncated pyramid. By folding the gable, "excess" double-layered package sleeve sections (also called "ears") are formed. Producing such a special package form imposes special requirements on the packaging machine.

A possible design of such a packaging machine can be seen in the exemplary embodiment shown. A mandrel wheel with nine working wheels (in short: mandrels) arranged over its circumference can be seen in the left area. The filling plant, which is of no further interest here, is arranged in the right section.

The mandrel wheel rotates cyclically in operation, so that the mandrels rotate between individual working positions (I to IX) and remain in in these positions for the production steps to be carried out, in order to join the pouring element to the sleeve and to basically form the top area of the package. The mandrel is fed a pouring element and a package sleeve in working positions I and II. These are then thermally activated at the joining areas (positions III and IV), i.e. the plastic material on the flange and on the package sleeve section is locally fused.

The gable area is handled by a gable press at position V. This forms the gable surfaces into a truncated pyramid shaped gable area and presses, amongst other things, the activated areas of the gable surfaces onto the activated flange of the pouring element and in this way produces a durable join between them.

In the subsequent working position VI, the ears formed are thermally activated at the corresponding place and are hence prepared for sealing to the respective gable surfaces of the package sleeve in position VII. To that end, the ears are folded (i.e. folded by machine) and folded down such that they are pressed onto the corresponding gable surface and are thus durably attached.

At position VIII, the package completed on one side in the gable area is then passed on to a cell chain of the filling plant, where it is filled through the bottom area which is still open, and after that it is sealed and the bottom area is completed. No production step is allocated to position IX.

Process steps V to VII are particularly critical: The gable press should, on the one hand, create a secure join between the pouring element and the package sleeve, but at the same time also should seal the formed ears towards the top, i.e. seal the package in a liquid-tight and preferably also in a gas-tight manner (step V). The ears sealed towards to the top are then thermally activated again (this time on their outsides) and are then mechanically folded and folded down by 90° around the fold line.

The thermal and mechanical loads in combination and in their interplay put the heaviest of demands on the material. Due to the deformation (folding), stresses appear particularly in the corner areas—i.e. in the area of the face abutments of the truncated pyramid shaped flange and the overhead end area of the fold line—to such a great extent that local material failure frequently occurs and so leakages arise from this.

EP 1503940 B1 also shows a package container, which consists of a pouring element and a package sleeve, whose upper part forms a truncated pyramid. In contrast to the package created in WO 2012/062565 A1, the excess package sleeve sections formed by folding the tapering package gable are not folded outwards but rather inwards. Therefore, no ears are formed. The package sleeve sections pointing inwards are multilayered during the joining process with the pouring element. The join is effected by ultrasound.

In addition to high-frequency vibrations, a static joining force is applied to the join partners. In order to compensate for the layer jumps between single layer and multilayer and hence distribute the static joining force as uniformly as possible over the entire circumference, outwardly projecting relief parts are formed in the area of the single layer. In addition, a local notch is incorporated into such a relief part to receive the longitudinal sealed seam of the package sleeve (double-layered here).

Although the corner areas of the join are exposed to lower stresses compared to those in WO 2012/062565 A1 (folding of the double layer only takes place over 45° in the unsealed state), such a multilayer structure in sections and the layer jumps arising as a result are disadvantageous for the sealing process in various different ways. On the one hand, the compensation elements on the pouring element have to be dimensionally precisely tailored to the layer jumps and, on the other hand, such a uniform application of energy over the whole circumference is largely made impossible. Therefore, joins formed in such a way frequently have leaks.

Other joining methods—such as bonding or the like—are known from the prior art. The joining and/or deforming processes are always critical process steps which impose high strength requirements on the join parts which they are not always able to meet.

SUMMARY OF THE INVENTION

Therefore, it is the object of the present invention to develop and enhance a pouring element and a composite package of the type mentioned at the beginning and previously described in more detail in such a way that the disadvantages described are overcome. In particular, joining and leak-tightness between the pouring element and the composite package should be improved and damage to them prevented.

This object is achieved with a pouring element as described herein, by the fact that receiving areas are formed in the area of the face abutments for the fold line of the package sleeve ears. The receiving areas in this way provide space for the fold line, so that for the folded down ear there is enough space for it to be deformed in the fold area. This has the advantage that the material is considerably less subject to compression (on the inside of the ear) and elongation (gable edge), since it can deform and give way in the direction of the receiving area.

The object according to the invention is also achieved by a composite package for liquid foods with a polyhedrally formed gable area and folded package sleeve ears, in which the gable is correspondingly joined to the polyhedrally formed flange of such a pouring element.

A further teaching of the invention makes provision for the receiving areas to be formed as roundings of the face abutments. These provide enough space between the flange and the package sleeve for the folds which form during deformation. Furthermore, rounded transitions are stronger in terms of the structural mechanics. In the case of thermal activation, a more uniform application of energy is also possible and the risk of "burning away" in the area of the face abutments is largely eliminated.

According to a further embodiment of the invention, the receiving areas are formed as bevels of the face abutments. The beveled surface in this way provides enough space on its outside between the flange and the package sleeve for receiving forming fold areas. Bevels are also relatively easy to accomplish in production terms.

In a further advantageous embodiment, the receiving areas are formed as pockets of the face abutments. Pockets, that is to say, negative inwardly formed formations, can make particularly good sense if the space provided—for example due to thick packaging material—is to be particularly large.

According to a further teaching of the invention, wing-like material projections are formed in the area of the face abutments. These provide additional material in the area of the package sleeve ears. In this way, leak-tightness can be further improved specifically in these critical areas.

Another teaching of the invention makes provision for at least one material rib to be formed on the joining faces of the flange. Such material ribs in turn provide joining material at the desired place. Moreover, they strengthen the flange in terms of the structural mechanics.

A further embodiment of the invention makes provision for the flange of the base body to be in the shape of a truncated pyramid. The four face abutments of the joining faces of the flange formed in this way consequently form advantageous folding angles with respect to the folding process of the package sleeve ears.

A further type of embodiment according to the invention makes provision for the base body to have a rectangular base plate and in particular the base plate can be square. In this way, an improved course of the strain lines in the base body can be obtained without causing damage to the pouring element.

A further advantageous embodiment of the invention makes provision for the base plate to form an overlap locally with respect to the flange. This protects the open package sleeve edge against damage of any kind and thus guarantees a lasting join between the pouring element and the package sleeve. In addition, it forms an alignment stop for the package sleeve.

A further teaching of the invention makes provision for the base body to have a pouring neck, wherein this pouring neck is initially sealed with a screw cap. This is a particularly advantageous pouring element alternative.

According to a further embodiment of the invention, the base body is closed below the pouring neck by means of a retaining wall and has a circumferential weakening zone.

Such a retaining wall additionally strengthens the pouring element, particularly in the area of the base plate and the pouring neck.

Further advantageous embodiments make provision for a barrier film to abut on the retaining wall, optionally also, for a handle 20 to be integrally formed on the retaining wall, so that it can be removed by manually pulling on the handle 20, or for a cutting element to be arranged in the pouring neck, so that the retaining wall can at least partly be cut open in the area of the weakening zone. These are particularly advantageous for the pouring element.

BRIEF DESCRIPTION OF THE DRAWINGS

The invention is explained in more detail below with the aid of the figures illustrating only one preferred exemplary embodiment.

DESCRIPTION OF THE INVENTION

Figure 1:
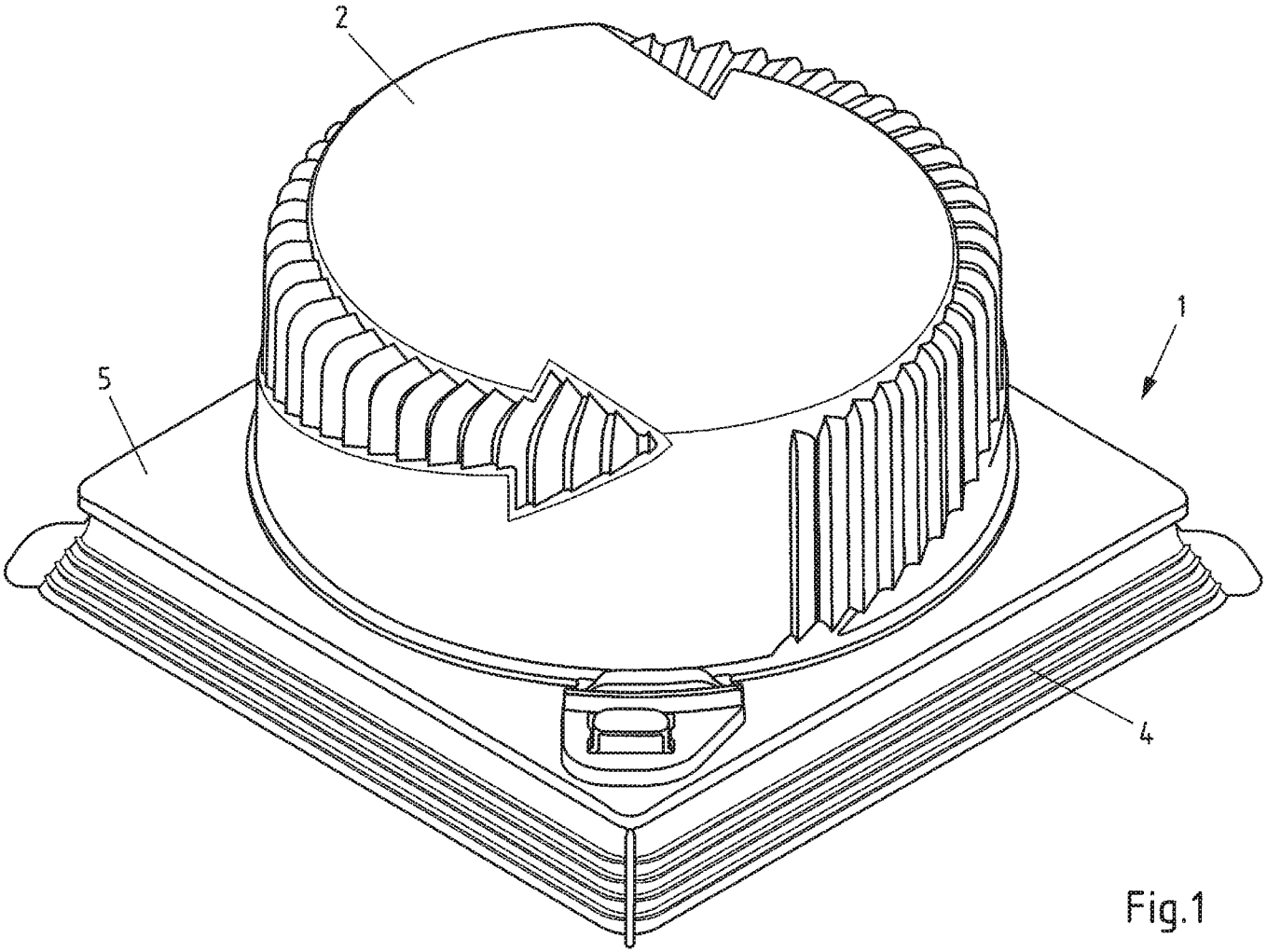
FIG. 1 shows a pouring element according to the invention in a perspective view at an angle from above.

FIG. 1 shows a preferred exemplary embodiment of a pouring element according to the invention in a perspective illustration at an angle from above. The pouring element in the illustrated and in this respect preferred exemplary embodiment has a base body 1 and a screw cap 2. The screw cap 2 fits on a pouring neck 3 (easily identifiable in FIG. 3A) which forms a part of the base body 1.

The base body 1 has a circumferential, polyhedrally formed flange 4 as a truncated pyramid. The flange 4 and the pouring neck 3 project in opposing directions from a square base plate 5 of the base body 1 and together form the actual base body 1.

Figure 2:
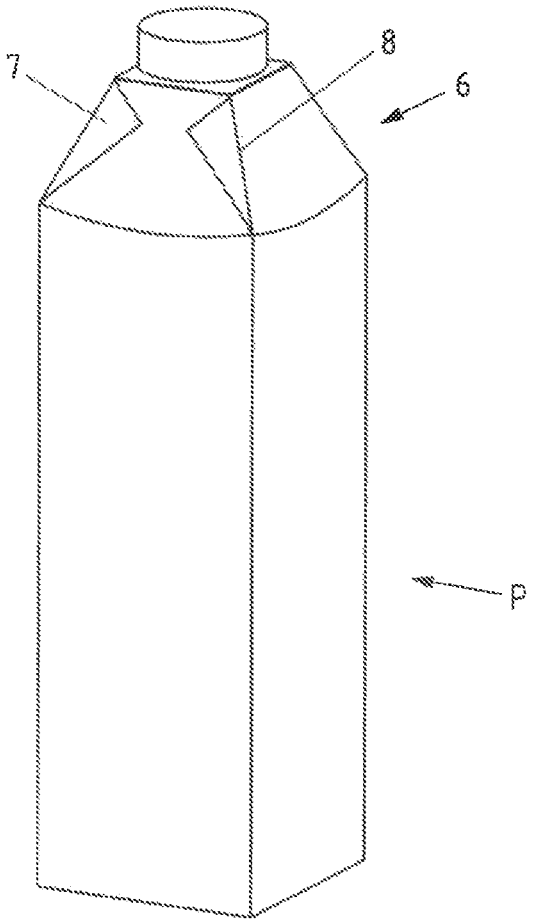
FIG. 2 shows a composite package according to the invention in a perspective view.

FIG. 2 shows a complete composite package P according to the invention with a polyhedrally formed gable area 6, here in the shape of a truncated pyramid. When forming the top area, the pouring element is joined to the package sleeve and the gable area 6 is formed by corresponding folds. The package sleeve ears 7, which are produced when the tapered gable area 6 is formed and consist of "excess" package sleeve material, are folded down over a fold line 8 until they abut on the gable surfaces of the gable area 6 and can consequently be durably attached.

Figure 3A:
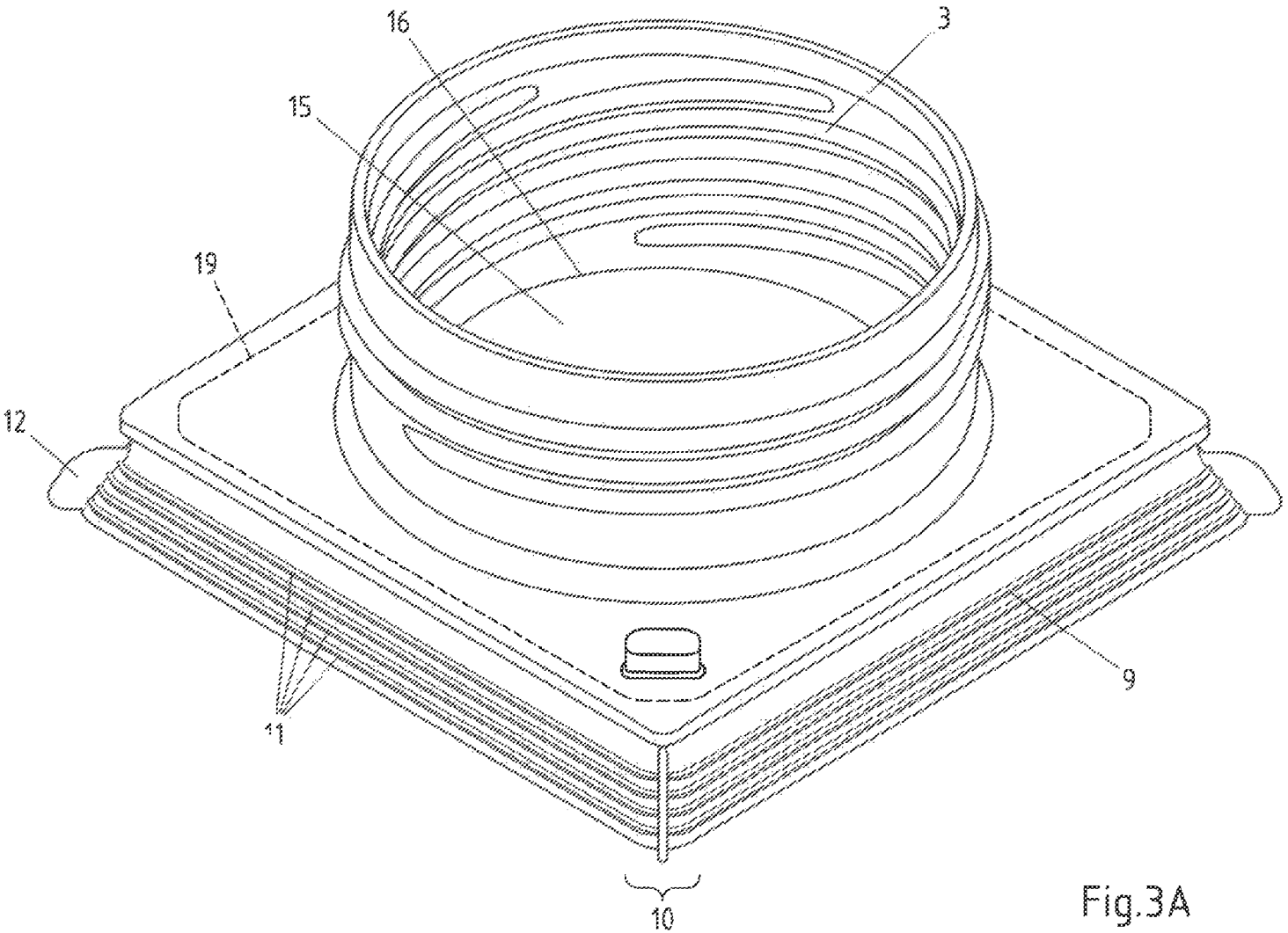
FIG. 3A shows the pouring element from FIG. 1 in a perspective view without the screw cap.
Figure 3B:
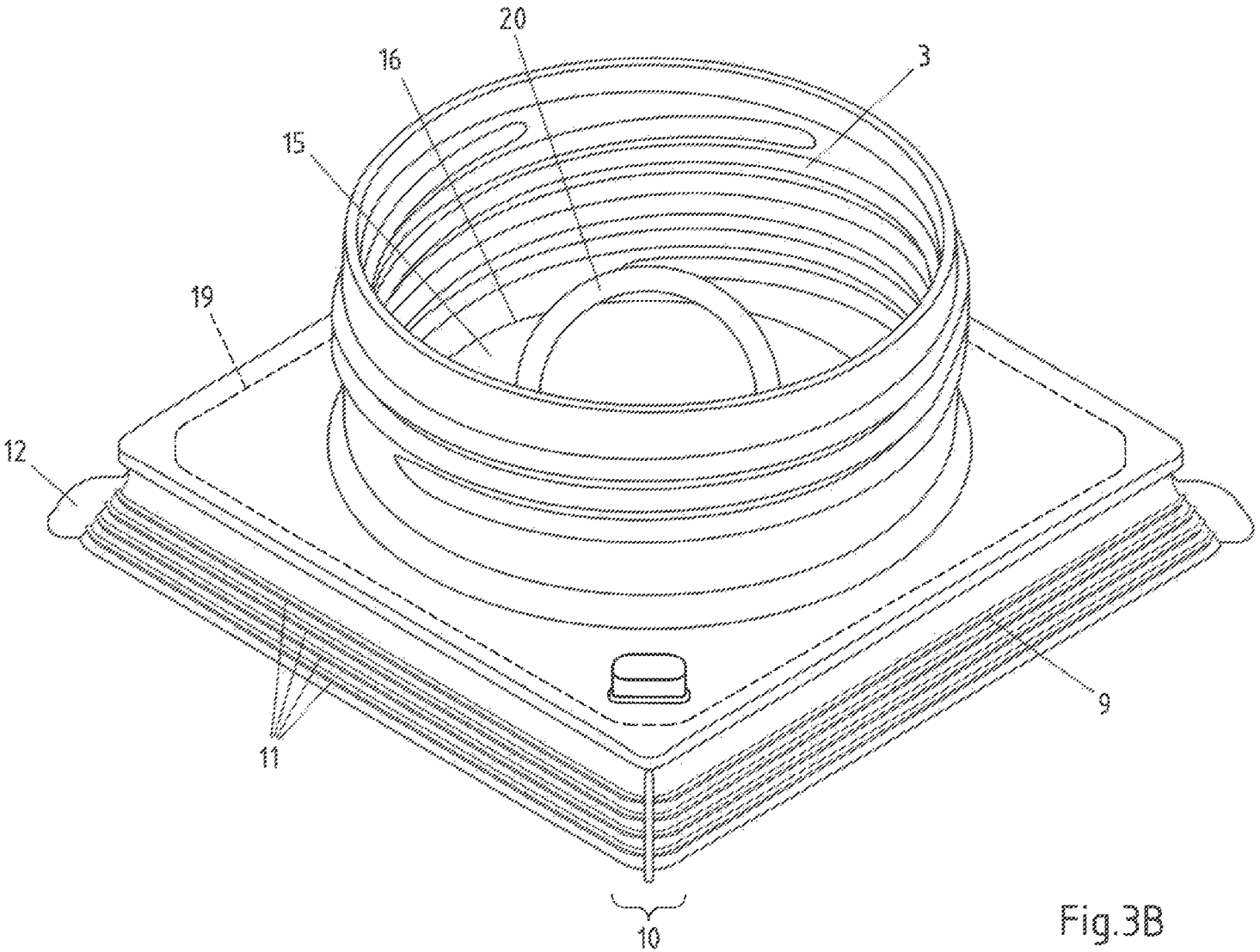
FIG. 3B shows another example of a pouring element in a perspective view without the screw cap.
Figure 3C:
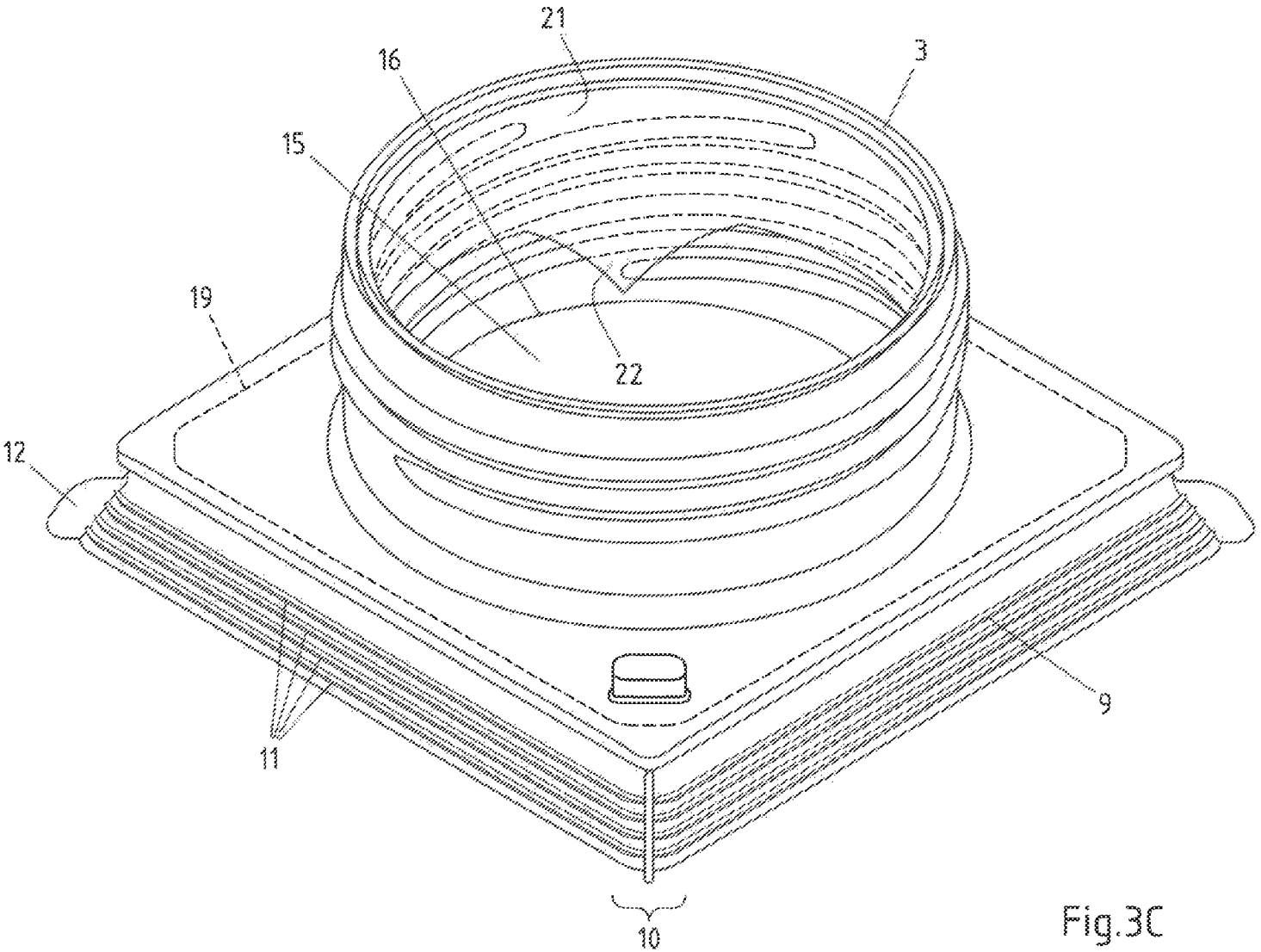
FIG. 3C shows another example of a pouring element in a perspective view without the screw cap.

The screw cap 2 is removed in the illustration in FIGS. 3A-3C, but it essentially corresponds to the one in FIG. 1. The polyhedrally formed flange 4 and in particular its joining surfaces 9 correspond to the gable surfaces of the polyhedrally formed gable area 6 of the composite package Pin shape and position. The join parts therefore lie parallel to one another. The joining surfaces 9 converge in face abutments 10; these correspond here to (imaginary) truncated pyramid edges. The joining surfaces 9 have material ribs 11 which strengthen the flange 4 mechanically and also provide sufficient material for the joining process.

Wing-like material projections 12 are likewise integrally formed in the face abutments 10, so that sufficient material is provided at the desired place for the joining process. The additional material in particular improves the sealing of the upper section of the package sleeve ear 7.

It can also be identified that the underside of the pouring neck 3 in its original state is sealed by a retaining wall 15. This is joined to the base body 1 via a weakening zone 16. A cutting element 22 at the bottom of a cutting ring 21 cuts through the weakening zone 16 when the screw cap is unscrewed for the first time and in this way exposes the opening for pouring through the pouring neck 3. In order to guarantee a sufficient shelf life and preserve the flavour of the filled product, a barrier film 19 is applied on the inside of the base plate 5 and retaining wall 15.

Figure 4:
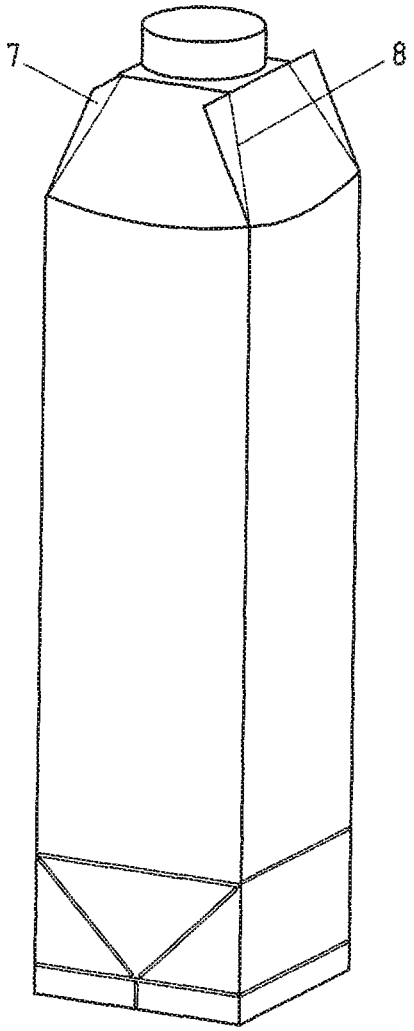
FIG. 4 shows a partly complete composite package from FIG. 2 without the ears set back

FIG. 4 shows a partly complete composite package, in which the pouring element is already joined to the package sleeve, but in the gable area 6 the package sleeve ears 7 have still not been folded down over the fold lines 8. The forming fold line 8 is illustrated here as a prepared crease in the package sleeve.

Figure 5A:
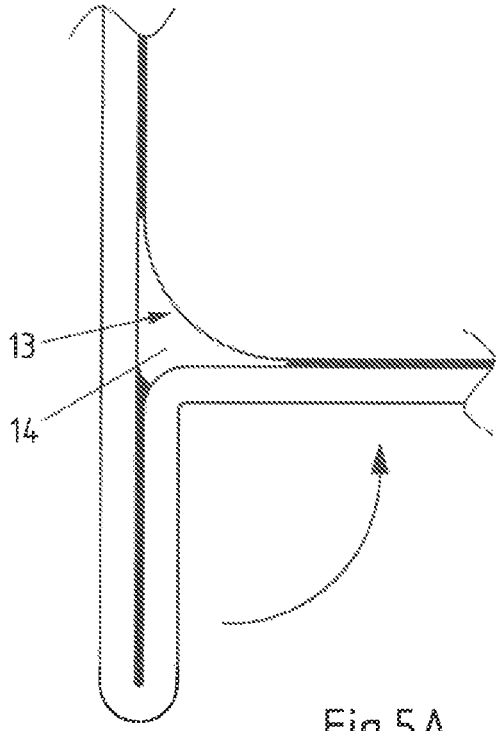
FIG. 5A shows a functional drawing of the folding process.
Figure 5B:
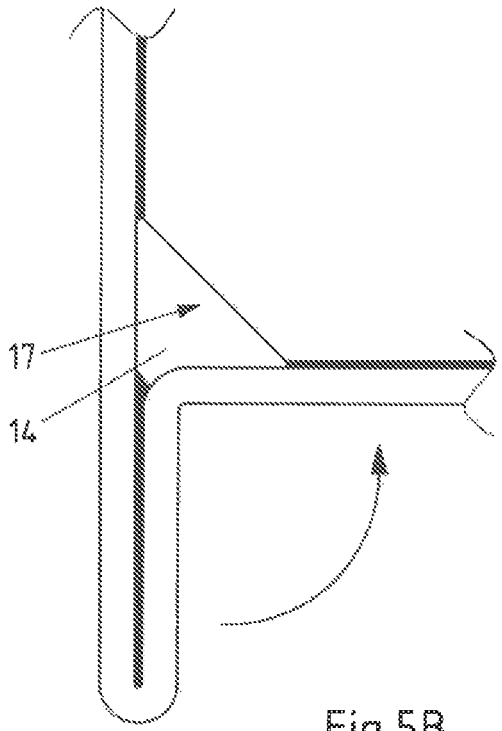
FIG. 5B shows a functional drawing of another example of a folding process.
Figure 5C:
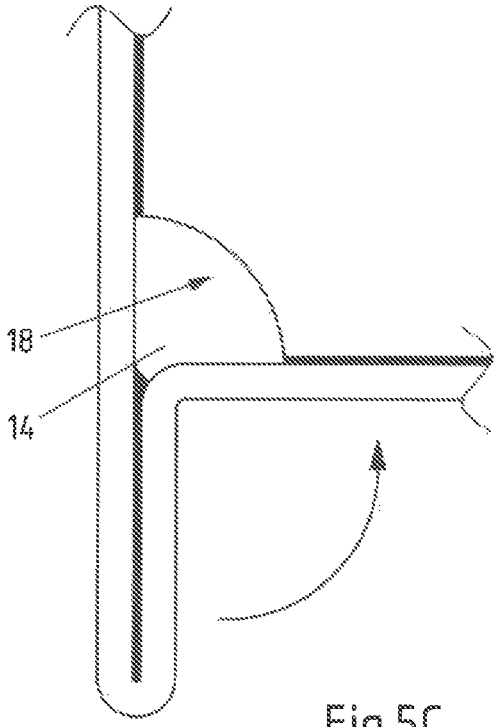
FIG. 5C shows a functional drawing of another example of a folding process.

FIG. 5A shows a functional drawing of the folding process which can be seen in a horizontally cut detail view through the flange 4 and the package sleeve ears 7 in the area of the face abutments 10 of the joining surfaces 9. The face abutments 10 in the illustrated and in this respect preferred exemplary embodiment are formed as positive roundings 13 of the flange 4 and form between their periphery and the package sleeve a receiving area 14 for the fold line 8 of the package sleeve ear 7. The deformation movements of the folding around the fold line 8 are indicated by the movement arrows. The possibility of giving away and receiving package sleeve material in the area of the fold line 8 into the receiving area 14 results in lower mechanical loads and in this way prevents damage. As shown in FIG. 5B, the receiving areas 14 may also be formed as bevels 17 of the face abutments 10. As shown in FIG. 5C, the receiving areas 14 may also be formed as pockets 18 of the face abutments 10.

The invention claimed is:

1. A pouring element for a package comprising a base body, a polyhedrally formed flange which is designed for joining to a package sleeve, wherein joining faces of the flange converge in face abutments, wherein receiving areas are formed in an area of the face abutments for a fold line of package sleeve ears, wherein the receiving areas are formed as roundings of the face abutments, and wherein the receiving areas are further defined as a space between the roundings and the package sleeve ears that are configured to receive packaging sleeve material when the package sleeve ears are folded.

2. The pouring element according to claim 1, wherein wing-like material projections are formed in the area of the face abutments.

3. The pouring element according to claim 1, wherein at least one material rib is formed on the joining faces of the flange.

4. The pouring element according to claim 1, wherein the flange of the base body is in a shape of a truncated pyramid.

5. The pouring element according to claim 1, wherein the base body has a rectangular base plate.

6. The pouring element according to claim 5, wherein the base plate is square.

7. The pouring element according to claim 5, wherein the base plate forms an overlap locally with respect to the flange.

8. The pouring element according to claim 1, wherein the base body has a pouring neck.

9. The pouring element according to claim 8, wherein the pouring neck is initially sealed with a screw cap.

10. The pouring element according to claim 8, wherein the base body is closed below the pouring neck by means of a retaining wall and has a circumferential weakening zone.

11. The pouring element according to claim 10, wherein a barrier film abuts on the retaining wall.

12. The pouring element according to claim 10, wherein a handle is integrally formed on the retaining wall, so that the retaining wall can be removed by manually pulling on the handle.

13. The pouring element according to claim 10, wherein a cutting element is arranged in the pouring neck, so that the retaining wall can at least partly be cut open in an area of the weakening zone.

14. The pouring element according to claim 1, wherein the pouring element is a composite package for liquid foods with a polyhedrally formed gable area and the folded package sleeve ears, wherein the gable area can be correspondingly joined to the polyhedrally formed flange.

* * * * *